United States Patent [19]

Block

[11] Patent Number: 4,506,405

[45] Date of Patent: Mar. 26, 1985

[54] FLOOR TREATING MACHINE

[75] Inventor: Thomas S. Block, Muskegon, Mich.

[73] Assignee: McGraw-Edison Company, Rolling Meadows, Ill.

[21] Appl. No.: 537,730

[22] Filed: Sep. 29, 1983

[51] Int. Cl.[3] ..... A47L 11/293

[52] U.S. Cl. ..... 15/320; 15/50 R; 15/98; 15/340

[58] Field of Search ..... 15/320, 49 R, 49 C, 15/50 R, 50 C, 340, 98

[56] References Cited

U.S. PATENT DOCUMENTS

| | | | |
|---|---|---|---|
| 2,622,254 | 12/1952 | Mendelson | 15/320 X |
| 2,930,055 | 3/1960 | Fallen et al. | 15/4 |
| 2,978,719 | 4/1961 | Arones | 15/320 X |
| 3,204,280 | 9/1965 | Campbell | 15/320 X |
| 3,277,511 | 10/1966 | Little et al. | 15/320 |
| 3,345,671 | 10/1967 | Wilson et al. | 15/320 |
| 3,942,215 | 3/1976 | Olds | 15/320 |
| 4,138,756 | 2/1979 | Krier et al. | 15/83 |
| 4,218,798 | 8/1980 | Block | 15/49 R |
| 4,295,243 | 10/1981 | King | 15/320 |

*Primary Examiner*—Chris K. Moore

*Attorney, Agent, or Firm*—John S. Paniaguas; Jon C. Gealow; James A. Gabala

[57] ABSTRACT

A floor treating machine adapted to operate as a floor scrubber and a floor polisher or buffer includes a main housing or support frame structure from which extends a brush housing assembly. The main housing contains a combined solution and recovery tank, a motive device to power the floor treating machine, a propulsion system to propel the floor treating machine along the floor, a pneumatic power system, a squeegee subassembly and electrical and pneumatic control systems therefor. The brush housing assembly is operatively connected to the main housing by a brush lifting mechanism such that two brushes selectively rotating in opposite directions in the brush housing assembly can be lifted away from the floor or moved toward the floor so that the brushes exert the correct amount of pressure against the floor depending on the job being done. The electrical and pneumatic control systems enable the floor treating machine to be selectively operated as a floor scrubber wherein the brushes in the brush housing assembly rotate at a relatively slow rotational speed and wherein the amount of pressure that the brushes exert against the floor is adjustable. The control systems also enable the floor treating machine to be selectively operated as a floor buffer or polisher wherein the brushes are rotated at a relatively high rotational speed and the brushes exert a relatively constant force or pressure against the floor.

19 Claims, 6 Drawing Figures

FLOOR TREATING MACHINE

BACKGROUND OF THE INVENTION

A. Field of the Invention

The present invention relates to a new and improved floor treating machine, and more particularly, to a new and improved floor treating machine which can be used both as a floor scrubber and a floor polisher or buffer and includes electric and pneumatic controls to operate the floor treating machine in the scrubbing and buffing modes.

B. Description of the Background Art

Floor treating machines presently available are used to scrub a hard floor surface with a cleaning solution. Such machines typically include a solution tank containing the cleaning fluid to be used in the scrubbing operation, a brush head assembly having at least one scrub brush to scrub the floor with the cleaning solution which is automatically metered to the brush heads from the solution tank and a soilage recovery system usually having a squeegee to collect the wet soilage or dirty solution and a vacuum system to pick up the collected wet dirty solution and to deposit the dirty solution in a recovery tank. Some of these machines are self-propelled, battery powered and are referred to as automatic floor scrubbers. The machines normally require only one person to operate and may clean floor surfaces at a rate of 24,000 to 30,000 square feet per hour.

Different aspects of one type of floor scrubber machine presently available is disclosed in Block U.S. Pat. Nos. 4,218,798; 4,251,896; 4,293,971; and 4,333,202, the disclosures of which are incorporated herein by reference.

Block U.S. Pat. No. 4,218,798 discloses the aspect of a floor treating machine including a brush subassembly and brush lift assembly. The brush lift assembly includes a lift arm pivoted to the support frame of the machine and a fluid operated diaphragm motor engaging the lift arm for pivoting the lift arm to lift the brush subassembly. The lift assembly either raises or lowers the brush subassembly.

Block U.S. Pat. No. 4,251,896, discloses the aspect of a gimbal connection for connecting brushes of a floor treating machine to a motor. This connection allows the brushes to shift axis of rotation to accommodate deviations in the surface being treated.

Block U.S. Pat. No. 4,293,971 is directed to the aspect of a squeegee assembly on a floor treating machine. The use of a coil spring to free a squeegee from direct rigid connection to the floor treating machine is specifically disclosed.

The aspect of a one piece tank for a floor scrubbing apparatus is disclosed in Block U.S. Pat. No. 4,333,202. The one piece tank defines both a recovery tank portion and a solution tank portion.

There also are presently available floor waxing or polish machines. These machines normally have a single brush and are not self-contained, but instead must be plugged into a source of AC power. Such a machine is disclosed in U.S. Pat. No. 2,930,055.

Some machines which have combined capability for scrubbing and polishing require separate scrubbing and buffing (or waxing) brushes often at different locations on the machine. The resultant machine is bulky and difficult to maneuver during floor treating operations. U.S. Pat. No. 3,204,280 discloses such a machine and also discloses a system for either raising or lowering the brushes. This machine lacks the capability to vary the pressure of these brushes on the surface being treated.

A machine for rotating several brushes at two speeds and either raising or lowering the brushes is disclosed in U.S. Pat. No. 3,942,215. Multiple brushes individually used for only one function are provided and the pressure of the brushes on the surface being treated cannot be varied. A bulky and unwieldy machine is the result.

U.S. Pat. No. 4,173,052 discloses a mechanical linkage system for varying the position of a brush relative to a surface being treated to compensate for wear of the brush. This mechanical system does not function to vary the pressure of the brush on the surface in accordance with the mode of operation of the machine.

A hydraulically operated street cleaning machine with an external power source is disclosed in U.S. Pat. No. 4,138,756. The disclosed machine includes one or more curb brushes and a single main brush the speed and downward pressure of which may be varied to a limited degree. Selective coupling to a power source to vary the speed and downward pressure of two brushes to perform the different functions of scrubbing and buffing is not disclosed.

SUMMARY OF THE INVENTION

An object of the present invention is to provide a new and improved floor treating machine.

Another object of the present invention is to provide a new and improved floor treating machine that can be used both as a floor scrubber and as a floor polisher or buffer.

A further object of the present invention is to provide a new and improved floor treating machine having a plurality of brushes which are rotated at a relatively slow speed when the floor treating machine is used as a floor scrubber and are rotated at a relatively high speed when the floor treating machine is used as a floor polisher or buffer.

A still further object of the present invention is to provide a new and improved floor treating machine in which the machine has control systems to selectively control the speed of rotation of the brushes and the pressure the brushes exert against a floor when the machine is used either as a floor scrubber or as a floor polisher or buffer.

Yet another object of the present invention is to provide a new and improved floor treating machine having an electrical and pneumatic control systems to control the speed the floor treating machine is propelled in forward and reverse directions along a floor and to control the speed of the rotation of the brushes and to allow variable control of the pressure which the brushes apply against the floor during the operation of the machine in one mode as a floor scrubber and to provide automatic control of the pressure of the brushes in another mode as a floor polisher.

Briefly, the present invention is directed to a new and improved floor treating machine having a main housing or support frame structure from which extends a brush housing assembly. The main housing has disposed therein a combined solution and recovery tank having a portion for cleaning solution to be used by the floor treating machine during the operation of the machine as a floor scrubber and another portion for receiving wet dirty solution vacuumed from the floor by a squeegee assembly. Power to operate the machine may be from several different sources. For example, the housing may contain a bank of batteries to power a propulsion system to propel the floor treating machine along the floor and to power brush and vacuum motors and other controls. The brush housing assembly is operatively connected to the main housing by a brush lifting mechanism such that two brushes rotating in opposite directions in the brush housing assembly can be lifted away from the floor or forced against the floor at appropriate pressures. Electrical and pneumatic control systems enable the floor treating machine to be selectively operated in a floor scrubbing mode wherein the brushes in the brush housing assembly rotate at a relatively slow rate while solution is provided to the brushes for scrubbing the floor and wherein the amount of pressure that the brushes exert against the floor is manually and infinitely adjustable and to be selectively operated in a buffing or polishing mode wherein the brushes are rotated at a relatively high speed and the brushes are automatically operated to exert a relatively constant force or pressure against the floor.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DETAILED DESCRIPTION OF THE PREFERRED EMBODIMENT

Figure 1:
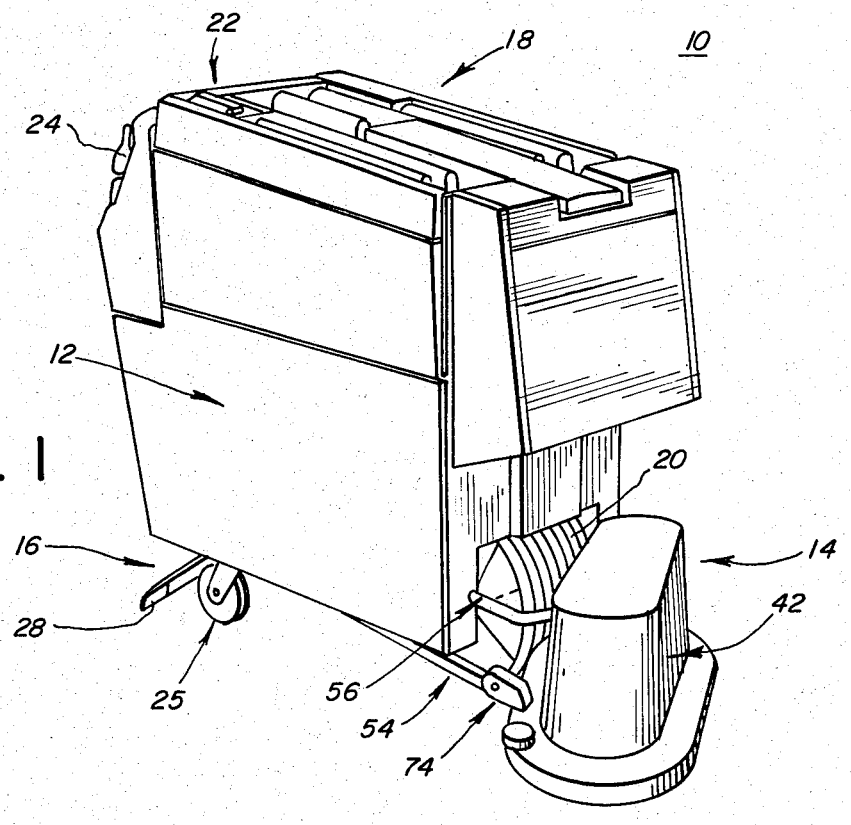
FIG. 1 is a front right side perspective view of an automatic floor treating machine in accordance with the present invention.
Figure 2:
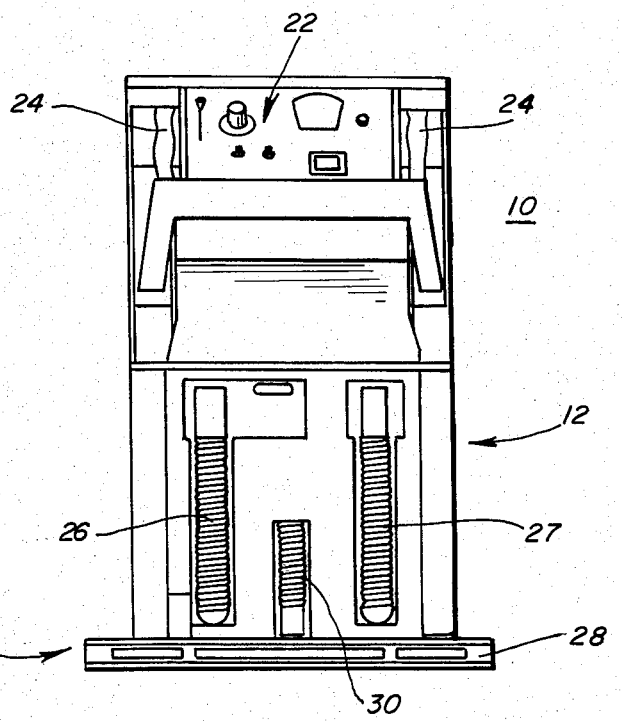
FIG. 2 is a rear elevational view of the floor treating machine of FIG. 1.

Referring to the drawings and initially to FIGS. 1 and 2, there is illustrated a floor treating machine in accordance with the present invention and which is generally designated by the reference numeral 10. The floor treating machine 10 is illustrated as a battery powered, floor scrubber and buffer but other power sources may be employed. Machine 10 includes a paneled main frame structure or housing 12 to which is secured a brush head or housing subassembly generally designated as 14, a squeegee subassembly generally designated as 16 and a combined solution and recovery tank generally designated as 18. The housing 12 contains a bank of batteries (not shown, but schematically shown in FIG. 6) which powers the floor treating machine 10 and provides power to rotate a floor engaging drive wheel 20 located at the front of the housing 12. When the drive wheel 20 rotates, the floor treating machine 10 is propelled along a floor surface. The main frame 12 also includes an appropriate operator control panel 22 from which an operator can control many of the functions of the floor treating machine 10 and a pair of control handles 24 which an operator of the floor treating machine 10 utilizes in guiding the floor treating machine 10 as it moves along a floor surface.

The floor treating machine 10 has a three point support composed of the main drive wheel 20 and a pair of laterally positioned and transversely spaced caster wheels 25 located near the rear of the main frame structure 12 just in front of the squeegee subassembly 16. As described in more detail in the above-mentioned Block U.S. Pat. No. 4,333,202, the combined solution and recovery tank 18 permits the use of this three point support because any instability of the housing 12 due to changes in the amount of liquid in the solution and recovery portions of the tank 18 is eliminated. At the rear of the housing 12, drain tubes 26 and 27 are provided so that the solution and recovery portions, respectively, of the tank 18 may be drained.

The squeegee subassembly 16 includes a squeegee 28 located at the rear lower portion of the main frame structure 12. As discussed in detail in the above referred to Block U.S. Pat. No. 4,293,971, the squeegee 28 engages a floor surface as the floor treating machine 10 is being used as a floor scrubber to collect cleaning solution which has been used in the floor scrubbing operation and which is directed by the squeegee 28 toward an inlet attached to a flexible tubing 30, through which tubing 30 dirty cleaning solution is pumped into the recovery portion of the tank 18. As will be described hereinafter, the squeegee 28 is raised away from the floor surface when the floor treating machine 10 is used as a floor scrubber or polisher or when the floor treating machine is in a nontreating mode.

Figure 3:
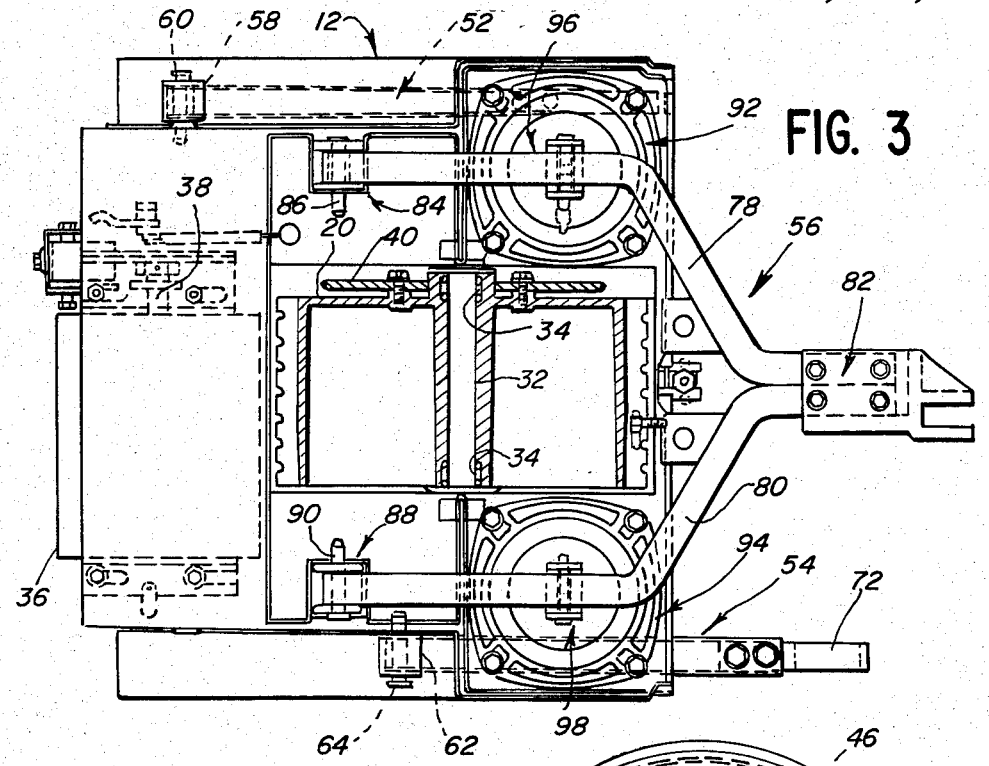
FIG. 3 is a top plan view of the support subassembly portion of the floor treating machine of FIG. 1.

One embodiment of the floor treating machine 10 is a unit which is moved along a floor surface in response to the rotation of the floor engaging wheel 20. The wheel 20 is rotatably mounted on an axle 32 by suitable bearings 34 near the front lower portion of the housing 12 (FIG. 3). As described in more detail in Block U.S. Pat. No. 4,218,798, the wheel 20 is rotated by means of an electric motor 36 mounted rearwardly of the wheel 20 in the housing 12. The electric motor 36 has an output shaft 38 which through a flexible transmission member, such as a roller chain, drives a sprocket 40 secured to the wheel 20. Consequently, as the sprocket 40 is rotated in response to the energization of the electric motor 36, the wheel 20 is rotated so that the floor treating machine 10 may be moved along in a forward or reverse direction. As will be discussed in more detail hereinafter, the direction and the speed the floor treating machine 10 is propelled along a floor surface is controlled by the operator of the machine primarily through the control handles 24.

Figure 4:
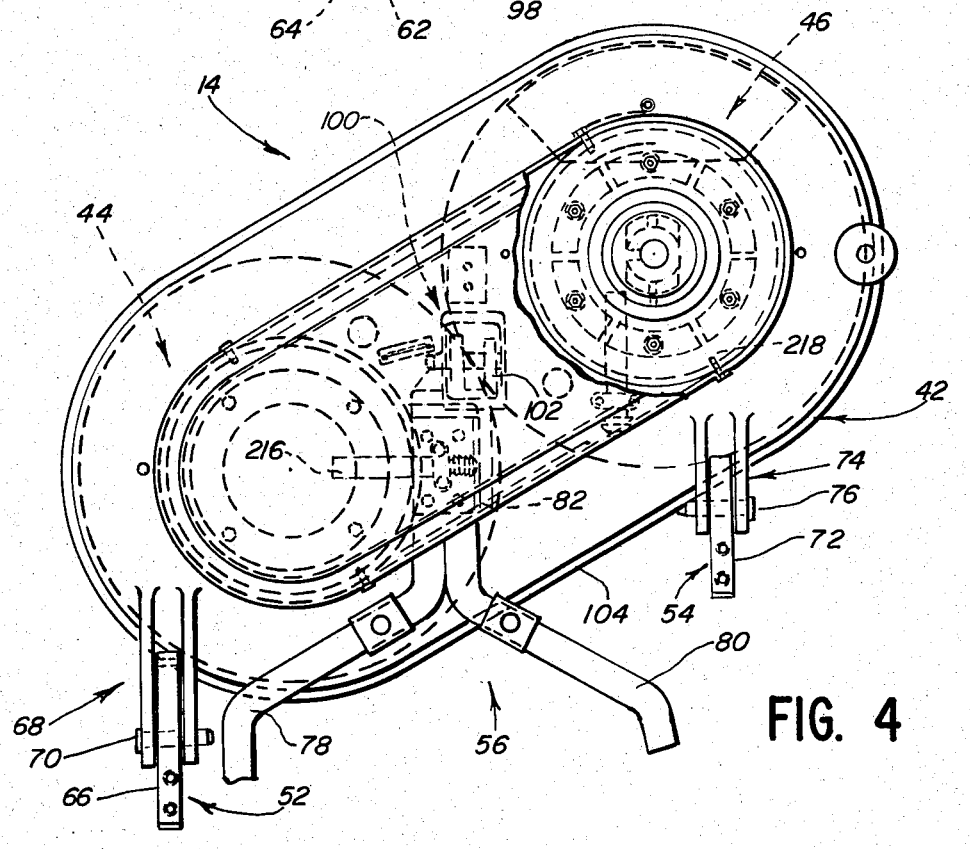
FIG. 4 is a top plan view of brush head subassembly portion of the floor treating machine of FIG. 1.

As best seen in FIG. 4, the brush head assembly 14 is operatively connected in front of the housing 12 and includes a brush housing 42 within which are located vertical axis rotary brushes 44 and 46. The brush 44 is rotated by a brush motor schematically shown as 48 in FIG. 5 and the brush 46 is rotated by a brush motor schematically shown as 50 in FIG. 5. The brush motors 48 and 50 are located above the brushes 44 and 46, respectively, in the brush housing 42. The manner in which the brushes 44 and 46 are connected to the brush motors 48 and 50, respectively, is described in more detail in the above referred to Block U.S. Pat. Nos. 4,218,798 and 4,251,896.

As best seen in FIGS. 3 and 4 of the drawings, the brush head assembly 14 is positioned in front of the housing 12 by tilt links or stabilizing arms 52 and 54 and by a brush lift mechanism 56. The stabilizing arm 52 is secured to the undersurface of the main frame structure 12 by a bracket 58 and a pivot pin 60. The stabilizing arm 54 is similarly connected to the undersurface of the housing 12 by a bracket 62 and a pin 64. A front portion 66 of the stabilizing arm 52 is slideably connected to the brush housing 42 by a bracket 68 and a connecting pin 70. Similarly, the stabilizing arm 54 has a forward portion 72 connected to the brush housing 42 by a bracket 74 and a pin 76.

The brush lifting mechanism 56 has a generally Y-shaped or bifurcated member defined by arm sections 78 and 80 joined together by a bracket 82. The arm 78 is pivotally secured to the housing 12 by a bracket 84 and a pin 86. The other arm 80 is connected to the underside of the housing 12 by a bracket 88 and a pin 90. The arms 78 and 80 are positioned above brush lift actuators 92 and 94, respectively. In the embodiment shown, the brush lift actuators are fluid operated diaphram motors. The actuator 92 has a stem 96 pivotally connected to the arm 78 and the actuator 92 has a stem 98 pivotally connected to the arm 80.

The bracket 82 coupling the arm sections 78 and 80 together is pivotally connected to a main lift bracket 100 centrally located in the brush housing 42. The bracket 82 is connected to the bracket 100 by a pivot pin 102. As is described in more detail in the above referred Block U.S. Pat. No. 4,218,798, the stabilizing arms 52 and 54 together with the lifting mechanism 56 maintains the brush housing 42 at an approximately 30° angle in front of the main frame structure 12 so that the areas on the floor engaged by the brushes 44 and 46 overlap each other.

The brush housing 42 can be moved up and down relative to the floor surface by the lifting mechanism 56 as the arms 78 and 80 are moved up and down by the stem portions 96 and 98 of the actuators 92 and 94, respectively. As the brush housing 42 is moved toward the floor, the brushes 44 and 46 will exert greater amounts of pressure or force against the floor surface whereas when the brush housing 42 is moved away from the floor, the brushes 44 and 46 will exert a lesser amount of force against the floor surface. This force can vary from essentially zero pounds to approximately 80 pounds. If desired, the lifting mechanism 56 can lift the brush housing 42 so that the brushes 44 and 46 are not engaging the floor and an operator would have access to the brushes 44 and 46. When the brush housing 42 is so lifted, the brush housing 42 is tilted upwardly relative to a rear or trailing edge 104 of the brush housing 42 due to the pivotal connection of the front portion 66 of the stabilizing arm 52 to the brush housing 42 by the bracket 68 and the front portion 72 of the stabilizing arm 54 to the brush housing 42 by the bracket 74.

Figure 5:
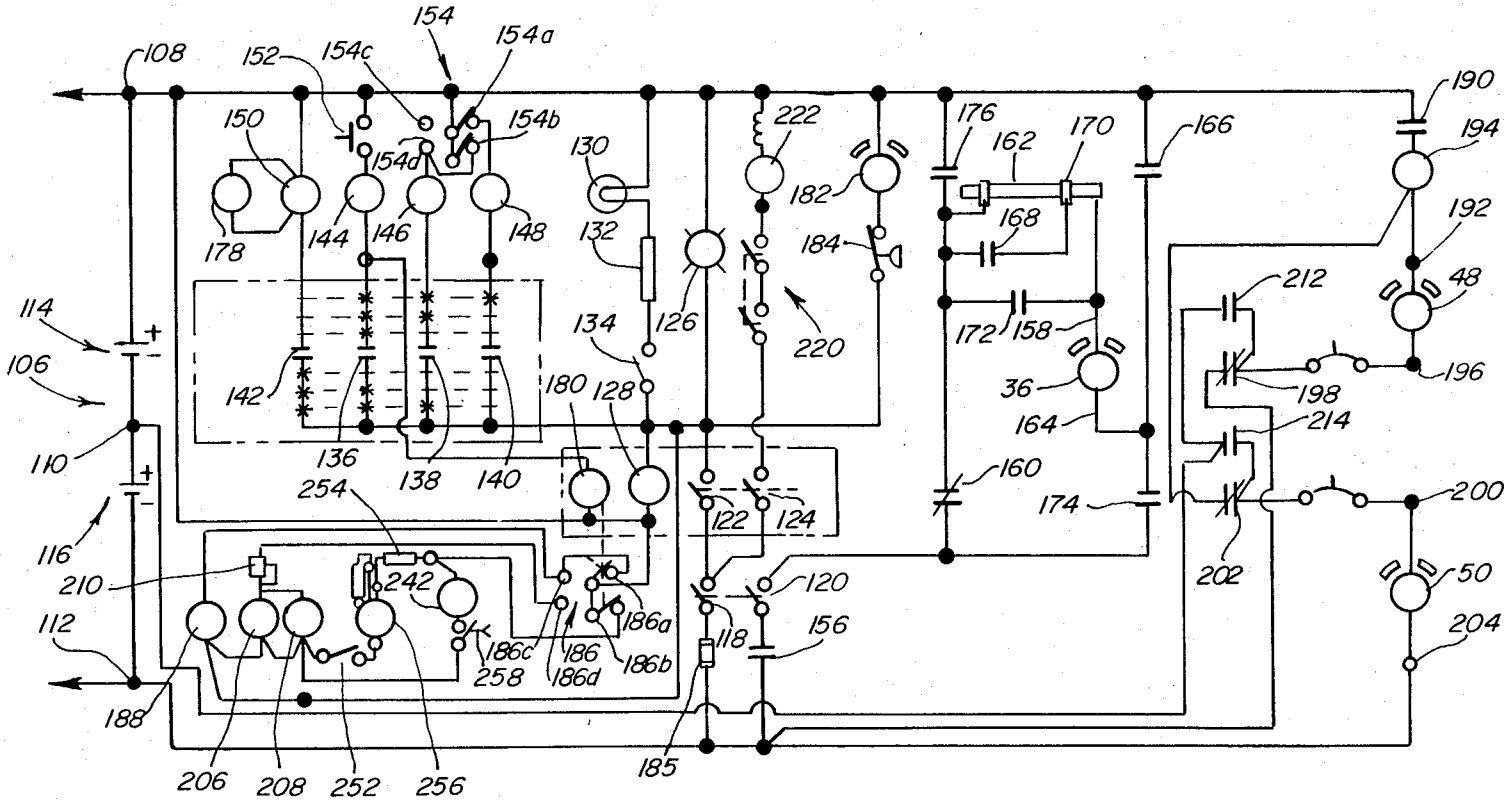
FIG. 5 is a schematic diagram of the electrical control circuit for controlling the operation of the floor treating machine of FIG. 1.
Figure 6:
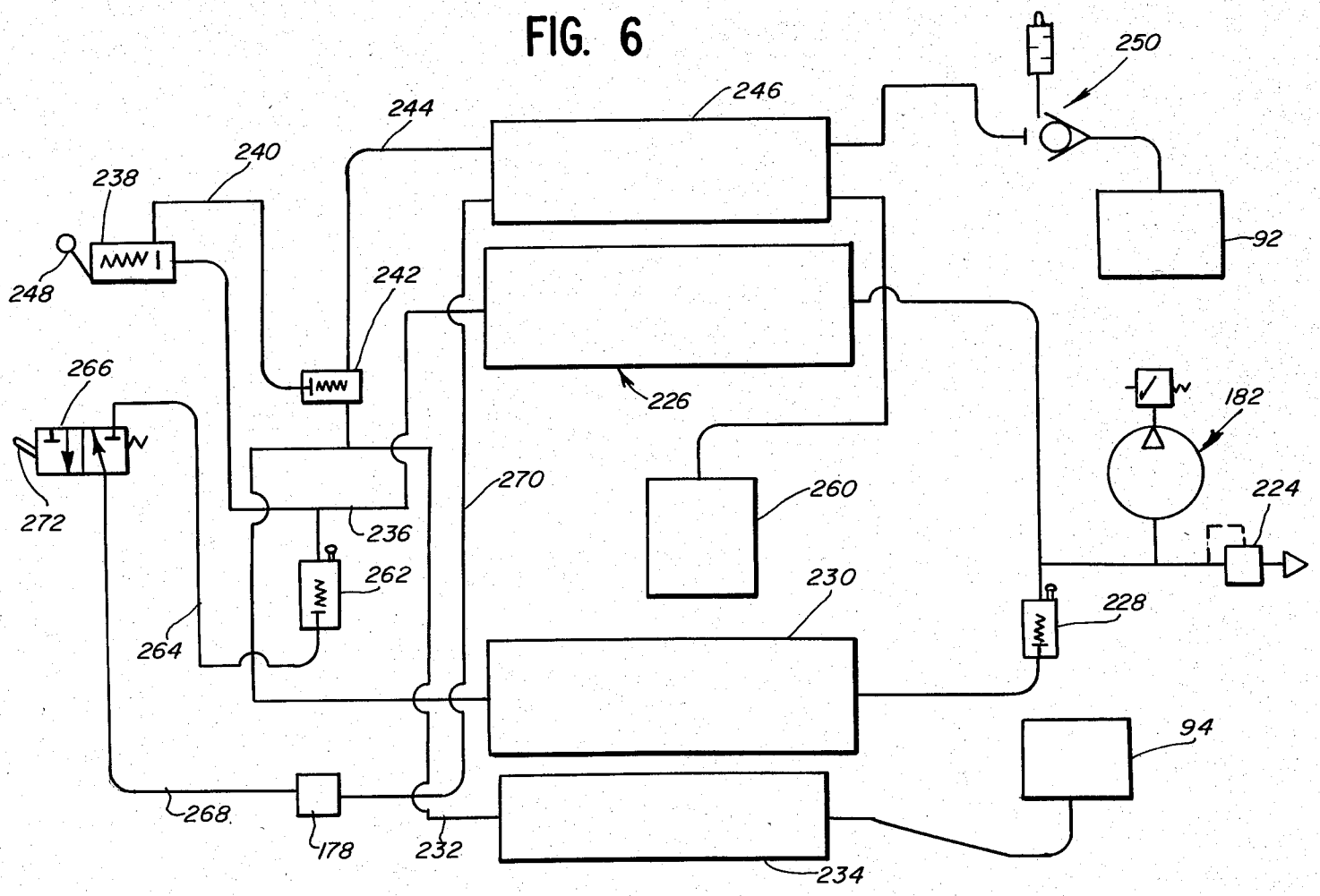
FIG. 6 is a schematic diagram of a pneumatic control system for controlling the various operations of the floor treating machine of FIG. 1.

The operation of the floor treating machine 10 is controlled by an electrical control system schematically shown in FIG. 5 in conjunction with a pneumatic control system schematically shown in FIG. 6 of the drawings. The floor treating machine 10 may be powered by several different power sources. For example, machine 10 may be a self-contained unit with a bank of batteries 106 (shown schematically in FIG. 5) located in the housing unit 12. The bank of batteries 106 can be of any suitable voltage, but the batteries must be capable of supplying a fixed voltage between terminals 108 and 110 and the same fixed voltage between terminals 110 and 112 and have sufficient capacity to provide the requisite motive and control power for operation of the machine. For example in a 36 volt system, six 6-volt batteries could be used to power the floor treating machine 10. Three of those batteries could be hooked together in series to act as a battery 114 to supply 18 volts DC potential between terminals 108 and 110. In this case the positive terminal of the battery 114 would be connected to the terminal 108 and the negative terminal of the battery 114 would be connected to the terminal 110. Another set of three 6-volt batteries could form the battery 116 so that 18 volts DC potential is supplied between the terminals 110 and 112 with the positive terminal of the battery 116 being connected to the terminal 110 and the negative terminal of the battery 116 being connected to the terminal 112.

When an operator of the floor treating machine 10 wants to begin operation of the machine 10, switches 118 and 120 located on the control panel 22 are closed. In addition, if present, key operated switches 122 and 124 located on the control panel 22 also are closed. When the switches 118 and 122 are closed a pilot light 126 on the control panel 22 is energized to indicate that the machine 10 is on. A voltmeter 128 registers the voltage across the terminals 108 and 112 so that an operator knows if the battery bank 106 is fully charged. If the batteries 114 and 116 are not properly charged, an external battery charger (not shown) can be plugged in across the terminals 108 and 112. The charger is connected to an AC power source to recharge the batteries 114 and 116 in the battery bank 106. In an alternate embodiment, a battery charger can be built into machine housing 12 and connected to an external AC power source. In the event that an operator wants to physically check the batteries 114 and 116 in the bank 106, a convenience light 130 in the battery bank compartment located in the housing 12 can be energized through a resistor 132 by the closing of a light switch 134.

With the switches 118 and 120 and the switches 122 and 124 closed, the floor treating machine 10 can now be moved by the drive wheel 20. The control of the movement or steering of the floor treating machine 10 is primarily controlled by the operator through the control handles 24 located at the rear of the housing 12 adjacent the control panel 22. Normally, the control handles 24 are in an off position so that contacts 136, 138, 140 and 142 are open. When an operator pushes the control handles 24 forward, the contacts 136, 138 and 140 selectively are closed. If an operator moves the control handles 24 from its off position backwards away from the front of the housing 12, the floor treating machine 10 will move in the reverse direction since this movement of the control handles 24 selectively closes the contacts 142, 136 and 138. As will be described in more detail hereinafter, the closing of the contacts 136, 138, 140 and/or 142 selectively energizes relays 144, 146, 148 and/or 150 and 178 such that appropriate energizing voltages are supplied to the drive motor 36 (schematically shown in FIG. 5, but also shown in FIG. 3). Motor 36 is a DC motor. Those skilled in the art realize that varying the armature voltage of DC motors proportionately varies the speed. It is also known that by changing the polarity of the DC voltage to the armature will reverse the direction that the motor rotates. Therefore, depending upon the magnitude of the voltage and the polarity of the voltage applied to the motor 36, the drive wheel 20 will be rotated by the motor 36 to move the floor treating machine 10 in a forward direction at one of three speeds or in a reverse direction in one of two speeds.

In an alternate embodiment, voltage varying means for varying the voltage to the motor armature can be connected into the circuit to vary the motor speeds in infinitesimal steps.

More specifically, in order for an operator to have the floor treating machine 10 move along a floor, a parking brake (not shown) on the housing 12 must be disengaged which results in the closing of a switch 152. Assuming that a switch 154 has its contacts 154*a* and 154*b* closed as is shown in FIG. 5, the movement of the control handles 24 forward will close contacts 136 and the relay 144 is energized. The energizing of the relay 144 closes contact 156 so that a relatively negative potential is supplied to a terminal 158 on the motor 36 through the closed contacts 156, the closed switch 120, normally closed contacts 160 and a resistor 162. A relatively positive potential will be applied to another terminal 164 of the drive motor 36 from the termimal 108 through normally closed contacts 166. Since the entire resistor 162 is in the circuit supplying power to the motor 36, the motor 36 will rotate at a relatively slow speed and in a direction to drive the drive wheel 20 so that the floor treating machine 10 will move in a forward direction.

If a slightly faster or medium forward speed is desired, the operator pushs the control handles 24 further forward so that not only will the contacts 136 be closed, but also the contacts 138 are closed. The closing of the contacts 138 energizes the relay 146 through the contacts 154*b* in the switch 154. When the relay 146 is energized, contacts 168 are closed and a relatively negative potential is supplied to the terminal 158 of the motor 36 through a tap 170 on the resistor 162 so that only a portion of the resistor 162 is in the circuit supplying potential to the motor 36. As a result, the motor 36 will increase in speed causing the drive wheel 20 to be rotated faster.

In order to increase the speed of the drive wheel 20 to move the floor treating machine 10 at its fastest speed, the operator pushs the control handles 24 even further forward closing the contacts 140 and energizing the relay 146 through the contacts 154*a*. Contacts 172 close and the relatively negative potential being supplied to the terminal 158 on the motor 36 no longer is being supplied through the resistor 162. As a result, the potential supplied to the motor 36 is increased and the speed of the motor 36 is also increased.

There are times that it is desired that an operator of the floor treating machine 10 should be able to move the floor treating machine 10 at a maximum medium or slow forward speed notwithstanding the position of the control handles 24. The switch 154 provides what might be termed a lock out feature such that when the floor treating machine 10 is to be moved at a relatively medium maximum velocity, the switch 154 is changed so that contacts 154*c* and 154*d* are closed instead of the contacts 154*a* and 154*b*. As a result of this change in the position of the lock out switch 154, the relay 148 cannot be energized so that the motor 36 is never supplied with sufficient potential to move the floor treating machine 10 at a speed greater than its medium forward speed. In the event that only the slowest forward speed is to be used, the operator positions the switch 154 so that none of the contacts 154*a*, 154*b*, 154*c* or 154*d* are closed and relays 146 and 148 will not be energized. As a result, only the lowest possible potential through the full resistor 162 can be applied to the motor 36.

In order for the operator of the floor treating machine 10 to reverse the direction of the floor treating machine 10, the operator pulls the control handles 24 rearwardly past the off position so that the contacts 142 are closed and the relay 150 is energized. With the relay 150 energized, the normally closed contacts 160 and 166 open and normally open contacts 174 and 176 close. In addition, the movement of the control handles 24 rearwardly closes the contacts 136 so that the relay 144 is also energized. As a result, a relatively negative potential is supplied through the contacts 156, the switch 120 and the contacts 174 to the terminal 164 on the motor 36. A relatively positive potential is supplied through the contacts 176 and the resistor 162 to the terminal 158 of the drive motor 36. Since this potential across the terminals 158 and 164 is opposite to the potential previously supplied to the motor 36 when the floor treating machine 10 was being moved in the forward direction, the motor 36 will rotate in the opposite direction so that the drive wheel 20 also will be rotated in the opposite direction and the floor treating machine 10 will move in the reverse direction.

If the speed of the floor treating machine 10 in the reverse direction is desired to be increased, the control handles 24 may be pulled backwards further thereby also closing contacts 138. As a result, the relatively positive potential being supplied to the terminal 158 through the closed contact 176 will now be supplied through the contacts 168 and the tap 170 on the resistor 162 so only a portion of the resistor 162 will be in the circuit supplying the relatively positive potential to the drive motor 36. Consequently, the potential across the motor 36 will be increased and the floor treating machine 10 will be put in a reverse mode at a higher speed.

The lock out switch 154 also can be used to limit the speed the floor treating machine 10 travels in the reverse direction. If the switch 154 is positioned so that all of the contacts 154*a*, 154*b*, 154*c* and, 154*d* are open, the relay 146 cannot be energized and only the slowest reverse speed can be attained.

Whenever the floor treating machine 10 is operated in the reverse direction by the closure of the contacts 142, energizing potential will also be supplied to a normally open solenoid 178 thereby closing the solenoid 178. As will be discussed in more detail in connection with the pneumatic control system shown in FIG. 6, the closing of the solenoid 178 results in the squeegee 28 being lifted off the floor surface so as to assure that the squeegee 28 does not inhibit the reverse movement of the floor treating machine 10.

As is also apparent, whenever the floor treating machine 10 is being operated in the forward or reverse direction, the contacts 136 are closed and if an hourmeter 180 is provided on the control panel 22 of the floor treating machine 10, the hourmeter 180 will be energized through the contacts 136 and show the number of hours that drive wheel 20 has been propelling the floor treating machine 10.

In order to provide air pressure to the pneumatic control system schematically shown in FIG. 6, a compressor 182 is provided in the housing 12 of the floor treating machine 10 and is energized by the closing of a switch 184. Whenever the switch 184 is closed, potential is applied to the compressor 182 through the switch 184, the closed switches 118 and 122 and a resistor 185.

The floor treating machine 10 has two modes of operation. In one mode of operation, the floor treating machine 10 is used as a floor scrubber and it is in this mode of operation that the brushes 44 and 46 should be rotated at a relatively slow speed by the motors 48 and 50, respectively. In its other mode of operation, the floor treating machine 10 is used as floor polisher or buffer and the brushes 44 and 46 should be rotated at a relatively high rotational speed by the motors 48 and 50, respectively. For example, when the floor treating machine 10 is used as a floor polisher, the brushes 44 and 46 may be rotated at approximately 900 revolutions per minute whereas when the floor treating machine 10 is used as a floor scrubber a rotational speed for the brushes 44 and 46 can be somewhere between 400 and 450 revolutions per minute. The speed at which the brush motors 48 and 50 rotate the brushes 44 and 46, respectively, is controlled by a switch 186. When the switch 186 is as shown in FIG. 5, contacts 186*a* and 186*b* are closed and the brushes 44 and 46 will be rotated at their high speed. In order to have the brushes 44 and 46 rotated at the lower speed, the switch 186 is changed so that contacts 186*c* and 186*d* are closed and the contacts 186*a* and 186*b* are opened. If the motors 48 and 50 are to be turned off, the switch 186 is positioned with all of the contacts 182*a*, 182*b*, 182*c* and 182*d* open.

Turning first to the situation when the brushes 44 and 46 are rotated at a relatively high speed in a floor buffing mode, the contacts 186*a* and 186*b* are closed and a positive potential is supplied through the contacts 186*a* to a relay 188 from the terminal 108 and a relatively negative potential is supplied to the relay 188 through the resistor 185 and the closed switches 118 and 122 from the terminal 112. As a result, the relay 188 is energized closing normally opened contacts 190. A terminal 192 of the motor 48 is then supplied with relatively positive potential from the terminal 108 through the closed contacts 190 and an ammeter 194. The other terminal 196 of the motor 48 is supplied with a relatively negative potential from the terminal 112 through normally closed contacts 198. With the potential so supplied to the motor 48, the motor 48 rotates the brush 44 in a clockwise direction as the brush 44 is viewed in FIG. 4. The positive potential from the terminal 108 is also supplied to a terminal 200 on the motor 50 through the cosed contacts 190, the ammeter 194 and normally closed contacts 202. The terminal 204 on the motor 50 is directly coupled to the relatively negative potential terminal 112. With this potential being supplied to the terminals 200 and 204, the motor 50 rotates the brush 46 in a counterclockwise direction as the brush 46 is viewed in FIG. 4. In this manner, the brushes 44 and 46 are rotated in the opposite directions and since the full 36 volt potential across the terminals 108 and 112 is being supplied to both the motors 48 and 50, the motors 48 and 50 rotate the brushes 44 and 46, respectively, at a relatively high rotational speed.

When the floor treating machine is to be used as a floor scrubber, it is desired to have the brushes 44 and 46 rotate at a lower rotational speed and this is accomplished by closing the contacts 186*c* and 186*d* in the switch 182 instead of the contacts 186*a* and 186*b*. The closing of the contacts 182*c* energizes the relay 188. With the contacts 186*d* closed, a relatively positive potential is supplied to relays 206 and 208 through a resistor 210. A relatively negative potential is supplied through the resistor 185 and closed switches 118 and 122 to the relays 206 and 208 so as to energize the relays 206 and 208. The energizing of relay 188 results in the contacts 190 being closed, the energization of relay 206 results in the opening of the contacts 198 and the closing of contacts 212, and the energization of relay 208 results in the opening of the contacts 202 and the closing of contacts 214. Consequently, a relatively positive potential is supplied through the contacts 190 and the ammeter 194 to the terminal 192 on the motor 48. The terminal 196 on the motor 48 will be supplied with the potential appearing at the center tap 110 in the battery bank 106 through now closed contacts 212. As a result, a potential of 18 volts is supplied across the terminals 192 and 196 of the motor 48 and the motor 48 will be rotated at about half the rotational speed it was rotated when the potential of 36 volts was being supplied to the motor 48. The terminals 200 and 204 on the motor 50 also are being energized with an 18 volt potential. The terminal 204 is still coupled directly to the negative terminal 112 in the battery bank 106. The terminal 200 is now coupled to the central tap terminal 110 through the now closed contacts 214. As a result, the motor 50 will also rotate at a lesser rate of speed. The potential across the motors 48 and 50 is still in the same polarity as it was when the motors 48 and 50 were being supplied with 36 volts such that the brush 44 will be rotated in the clockwise direction and the brush 46 will be rotated in the counterclockwise direction as the brushes 44 and 46 are viewed in FIG. 4.

In an alternate embodiment, the speed of brush motors 48 and 50 is varied by varying resistances wired in series with the battery supply 106 or the motors 48 and 50.

During the operation of the floor treating machine 10 as a floor scrubber, cleaning solution from the solution portion of the tank 18 is supplied to the brushes 44 and 46. In order to accomplish this and as best seen in FIG. 4, a tube 216 is supported above the brush 44 and a tube 218 is positioned above the brush 46. The tubes 216 and 218 are supplied with a metered amount of cleaning solution used in scrubbing a floor surface by appropriate tubing or hosing (not shown) connected to the solution tank portion of the tank 18 so that the cleaning solution is sprayed onto the floor as the brushes 44 and 46 are rotated.

It is desirable during the operation of the floor treating machine 10 as a floor scrubber to collect and pick up the wet dirty cleaning solution with which the floor has been scrubbed by the brushes 44 and 46. The collecting of the dirty cleaning solution is accomplished by the squeegee assembly 16 at the rear of the housing 12. More specifically, the squeegee 28 collects the wet dirty solution and the operator of the floor treating machine 10 can deposit the wet dirty solution through the tube 30 into the recovery portion of the tank 18 by closing a switch 220 on the control panel 22. The closing of the switch 220 energizes a vacuum pump 222 which is associated with the tube 30 and which pumps the dirty solution through the tube 30 to the recovery portion of the tank 18.

The electrical control system schematically shown in FIG. 5 is used in conjunction with the pneumatic control system shown in FIG. 6 to regulate the position of the brush head subassembly 14 relative to the floor surface and to thereby regulate the force the brushes 44 and 46 exert against the floor surface. In addition, the force with which the squeegee 28 engages the floor is also regulated. More specifically, and with particular reference to the control system shown in FIG. 6, the pneumatic fluid pressure for the floor treating machine 10 is provided by the compressor 182 which is energized by the closing of the switch 184 on the control panel 22. The compressor 182 provides fluid (air) under pressure. For example, a relief valve 224 associated with the compressor 182 can regulate the pressure of the fluid from the compressor 182 to 80 psi. This pressurized fluid is supplied to a high pressure reservoir 226. An air regulator 228 connected to the output of the compressor 182 regulates the air being supplied to a low pressure reservoir 230. For example, the air pressure being supplied to the reservoir 230 can be approximately 8.7 psi.

When the floor treating machine 10 is turned on by the closing of the switches 118, 120, 122 and 124, the compressor 182 may be turned on by the closing of the switch 184. In the event that the speed control switch 186 is in its off position so that the motors 48 and 50 are not energized, the low pressure from the reservoir 230 will be supplied to the brush lift actuator 94 through a hose 232 extending through the right hand frame portion 234 of the housing 12. In addition, the high fluid pressure from the reservoir 226 is supplied through a hose 236, a brush valve assembly 238, a hose 240, normally closed solenoid 242 (shown schematically both in FIGS. 5 and 6) and a hose 244 extending through a left frame portion 246 of the housing 12 to the brush lift actuator 92. Solenoid 242 connects hose 240 to hose 244.

The brush valve assembly 238 has a cam lever 248 which upon manual movement by the machine operator through an infinite number of positions controls the amount of air pressure that is supplied from the reservoir 226 through the solenoid 242 to the actuator 92. As the pressure supplied from the high pressure reservoir 226 to the brush lift actuator 92 is increased under the control of the cam lever 248, the stem 96 connected to the arm section 78 will lift the arm 78 as viewed in FIG. 3 such that the brush housing 42 will be lifted away from the floor surface. The lifting of the brush housing 42 will be aided by the low pressure being supplied to the actuator 94 from the reservoir 230 because the stem 98 will place a lifting force on the arm section 80. Further increases of the pressure through the valve 238 to the brush lift actuator 92 will lift the brush housing 42 even more and it will tilt upwardly relative to the trailing edge 104 as described heretofore. When the brush housing 42 is so lifted, an operator has access to the brushes 44 and 46 so that the brushes 44 and 46 can be changed or the like.

In order to have the brushes 44 and 46 engage the floor, the cam lever 248 is manually pushed downwardly as seen in FIG. 6 decreasing the high pressure from the reservoir 226 to the brush lift actuator 92. When the pressure is lowered sufficiently a quick exhaust valve 250 is open so that the pressure in the brush lift actuator 92 is quickly exhausted from the brush lift actuator 92.

In order to place the floor treating machine 10 in its low speed scrub mode, the brush speed control speed switch 186 is altered to close the contacts 186*c* and 186*d*. The closing of the contacts 186*c* and 186*d* does not affect the condition of the brush solenoid 242 and the solenoid 242 remains closed. The brush lift actuator 94 is still provided with low pressure from the reservoir 230 through the hose 232. Likewise, the brush lift actuator 92 is provided with pressure from the reservoir 226 through the hose 236, the valve 238, the hose 240, the solenoid 242, and the hose 244. The amount of pressure supplied to the brush lift actuator 92 again is controlled by the movement of the cam lever 248 which controls the amount of pressure provided through the valve 238. Consequently, when the floor treating machine 10 is in its low speed scrub mode, the portion of the brush housing 42 relative to the floor and thereby the amount of force applied by the brushes 44 and 46 against a floor is infinitely adjustable by manually adjusting the cam lever 248 on the valve 238. The brushes 44 and 46 exert a maximum pressure against the floor when the cam lever 248 is adjusted so that essentially no pressure is applied to the brush lift actuator 92 or exert a minimum or zero pressure against the floor when the pressure from the reservoir 226 to the brush lift actuator 92 is increased.

When the floor treating machine 10 is to be operated in the high speed mode of the brushes 44 and 46 so that the floor treating machine 10 is used as a floor buffer, the cam lever 248 is automatically moved all the way down to its lowest position in FIG. 6 as the machine 10 is switched to the high speed mode. This cuts off the pressure being supplied from the reservoir 226 through the valve 238 and the quick exhaust valve 250 exhausts the air pressure in the brush lift actuator 92. The lowering of the cam lever 248 also closes a switch 252 (FIG. 5). When the brush speed control switch 186 is changed to its high speed position with the contacts 186*a* and 186*b* closed, positive potential is supplied from the terminal 108 through the contacts 186*b* and a resistor 254 to a timer relay 256. The timer relay 256 is also connected through the closed switch 252 to the relative negative potential of the terminal 112 through the resistor 185 and the closed switches 118 and 122. As a result the timer 256 is activated. After a predetermined period of time, such as approximately five seconds, contacts 258 are closed resulting in the opening of the brush solenoid 242.

As best seen in FIG. 6, the opening of the brush solenoid 242 permits the supplying of low pressure from the reservoir 230 to the brush lift actuator 92 by means of the hoses 232 and 244. In addition, low pressure from the reservoir 230 is also supplied to the brush lift actuator 94 through the hose 232. With both of the brush lift actuators 92 and 94 supplied with low pressure from the reservoir 230, the brush housing 42 is maintained at a constant level above the floor such that the brushes 44 and 46 contact the floor and exert a contact pressure against the floor. For example, when both the brush lifters 92 and 94 are supplied with the low pressure from the reservoir 230, the brushes 44 and 46 can exert 25 to 30 pounds pressure against the floor whereas when no pressure is supplied to the actuator 92, the brushes 44 and 46 exert about 80 pounds of pressure on the floor surface. Consequently, the pressure against the floor of the brushes 44 and 46 are maintained at a constant pressure during the high speed buffing mode due to the fact that upon the closing of the contacts 186*b* the brush solenoid 242 opens after a short time delay. The position of brushes 44 and 46 is automatically controlled such that brushes 44 and 46 apply a predetermined pressure and may not be varied by the operator as can be done in the scrubbing mode. This avoids too much pressure being applied by the brushes 44 and 46 during the high speed buffing mode that could overload the machine 10 resulting in failure.

In an alternate embodiment conduit means are used in place of hoses.

As noted above, the pneumatic control system also controls the engagement of the squeegee 28 with the floor surface. As is specifically shown in the abovementioned U.S. Pat. No. 4,293,971, the squeegee 28 is normally biased away from the floor surface by a spring mechanism (not shown). In order to force the squeegee 28 against the floor during the scrubbing mode of operation, a squeegee actuator 260 (FIG. 6) is provided. The squeegee actuator 260 is provided with pressure from the high pressure reservoir 226 through the hose 236, an air regulator 262, a hose 264, a squeegee control valve 266, a hose 268, normally open squeegee solenoid 178 and a hose 270 which extends through the left side frame 246 of the housing 12. Whenever the squeegee actuator 260 is provided with this air pressure, the squeegee 28 is forced towards the floor. The amount of force with which the squeegee 28 will engage the floor is controlled by a lever 272 on the squeegee valve 266 which controls the amount of pressure being supplied to the squeegee actuator 260. Consequently, the lever 272 on the valve 266 acts as a manual control of the engagement of the squeegee 28 with the floor. For example, the squeegee 28 would be manually placed in its up position when the floor treating machine 10 is not in a floor scrubbing mode. It is important that the squeegee 28 is not engaging the floor when the floor treating machine 10 is moved in a reverse direction. As a result, it is necessary to ensure that no air pressure is provided to the squeegee actuator 260 whenever the floor treating machine 10 is placed in a reverse direction. Accordingly, as discussed above with respect to the schematic diagram of FIG. 5, the solenoid 178 is automatically closed whenever the contacts 142 are closed in response to the floor treating machine 10 being placed in a reverse movement direction and the squeegee 28 will be lifted from engagement with the floor.

What is claimed and sought to be secured by Letters Patent of the United States is:

1. A floor treating machine for treating a floor having a frame structure, a brush housing operatively connected to said frame structure and rotatable floor treating brush means, said floor treating machine comprising:

a brush lifting means for selectively lifting the brush housing away from and lowering the brush housing towards said floor, and a control means for operating said floor treating machine in a first mode wherein said brush means is rotated at a relatively high rotational speed and said brush lifting means automatically maintains said brush housing at a first position relative to said floor and a second mode wherein said brush means is rotated at a relatively slower rotational speed and said brush lifting means being infinitely variable to vary the position and the pressure of said brush housing relative to said floor.

2. The floor treating machine as set forth in claim 1 wherein said floor treating machine is used as a floor buffing machine when said control means operates said floor treating machine in said first mode and said floor treating machine is used as a floor scrubbing machine when said control means operates said floor treating machine in said second mode.

3. The floor treating machine as set forth in claim 1 wherein said control means includes manual adjustable means for controlling said brush lifting means to adjust the position of the brush housing relative to said floor when said floor treating machine is operated in said second mode.

4. The floor treating machine as set forth in claim 3 wherein said brush lifting means includes first and second brush lifting actuators, said adjustable means manually operable for controlling said first brush lifting actuator to vary the brush housing relative to said floor when said floor treating machine is operated in said second mode.

5. The floor treating machine as set forth in claim 1 including tank means located in said frame structure to store cleaning solution to be used in said second mode of operation and squeegee means operatively connected to said frame structure to collect said cleaning solution after being used in said second mode of operation, said squeegee means including vacuum means to deposit said solution in said tank means after it is used in said second mode of operation.

6. The floor treating machine as set forth in claim 5 wherein said squeegee means includes a floor engaging means and said control means has squeegee adjusting means to adjust the engagement of said floor engaging means with said floor.

7. A floor treating machine for treating a floor having a main housing and a brush housing, said brush housing including motor means to rotate floor treating brush means, said floor treating machine comprising:

a source of pressurized fluid disposed in said main housing, a brush positioning means for positioning said brush housing relative to said floor, and control means for operating said floor treating machine in a first operative mode wherein motor means rotates said brush means at a first rotational speed and wherein said source of pressurized fluid enables said brush positioning means to automatically position said brush housing at a first preselected position relative to said floor and in a second operative mode wherein said motor means rotates said brush means at a second rotational speed and wherein said source of pressurized fluid enables said brush positioning means to position said brush housing at variable positions relative to said floor.

8. The floor treating machine as set forth in claim 7 wherein said control means has adjusting means to enable said source of pressurized fluid to lift said brush housing away from said floor so that said brush means does not contact said floor.

9. The floor treating machine as set forth in claim 7 further comprising a source of DC potential, said source of DC potential including a first DC potential source and a second DC potential source, said first and second DC potential sources providing equal DC potential and wherein said control means has brush speed control means to apply said first and second DC potential sources to said motor means to rotate said brush means at said first rotational speed or to apply either said first or said second DC potential source to said motor means to rotate said brush means at said second rotational speed.

10. The floor treating machine as set forth in claim 9 wherein said motor means includes first and second brush motor means and wherein said floor treating brush means includes first and second brushes, said first brush motor means operatively connected to said first brush and said second brush motor means being operatively connected to said second brush and further wherein said brush speed control means couples said first and second DC potential sources to both of said first and second brush motor means when said floor treating machine is operated in said first operative mode and couples said first DC potential source to said first brush motor means and said second DC potential source to said second brush motor means when said floor treating machine is operated in said second operative mode.

11. The floor treating machine as set forth in claim 10 wherein said first and second DC potential each supply approximately 18 volts DC potential for said floor treating machine such that said first and second DC potential sources together supply approximately 36 volts DC potential for said floor treating machine.

12. The floor treating machine as set forth in claim 7 wherein said source of fluid under pressure has first and second pressure sources, said first pressure source being supplied to said brush positioning means when said control means operates said floor treating machine in said first operative mode and said first and second pressure sources are supplied to said brush positioning means when said control means operates said floor treating machine in said second operative mode.

13. The floor treating machine as set forth in claim 12 wherein said second pressure source supplies a fluid at a significantly greater pressure than the pressure of the fluid being supplied by said first pressure source.

14. The floor treating machine as set forth in claim 13 wherein said brush positioning means includes first and second brush housing lifting means and wherein said control means includes brush speed control means to selectively operate said brush means at said first or second rotational speeds or to selectively deactivate said brush means and wherein said control means further includes pressure control means, said pressure control means supplying said first pressure source to said first and second brush housing lifting means only when said brush speed control means operates said brush means at said first rotational speed and said pressure control means supplying said first pressure source to said second brush housing lifting means and said second pressure source to said first brush housing lifting means when said brush speed control means operates said brush means at said second rotational speed or deactivates said brush means.

15. The floor treating means as set forth in claim 14 wherein said control means includes time delay means to delay for a predetermined time period the supplying of said first pressure source to said first brush housing lifting means after said speed control means begin operating said brush means in said first operative mode.

16. The floor treating machine as set forth in claim 13 wherein said control means includes pressure control means to control the supplying of said first and second pressure sources to said brush positioning means, said pressure control means including adjustable means to adjust the amount of said second pressure source being supplied to said brush positioning means.

17. A floor treating apparatus for treating a floor surface having a main frame structure, a brush housing assembly operatively connected to said main frame structure, said brush housing assembly having rotatable floor treating brush means, said floor treating apparatus comprising:

a brush lifting means manually operable for selectively lifting the brush housing assembly relative to said floor surface in a second mode of operation and automatically operable to a preselected position in a first mode of operation, a propulsion system including wheel means engaging said floor to move said floor treating apparatus along said floor surface, and control means for supplying said electrical potential to said propulsion system to move said floor treating apparatus along said floor surface at variable speeds and for operating said floor treating apparatus in a first mode of operation wherein said floor treating apparatus is used as a floor buffer and a second mode of operation where said floor treating apparatus is used as a floor scrubber.

18. The floor treating apparatus as set forth in claim 17 including a source of DC potential and a compressor means disposed in said main frame structure operated by said source of DC potential and wherein said control means includes pneumatic control means to operatively connect said compressor means to said brush lifting means.

19. The floor treating apparatus as set forth in claim 17 wherein said brush housing assembly includes brush motor means to rotate said floor treating brush means, said control means controlling said brush motor means to rotate said floor treating brush means at a first rotational speed when said floor treating apparatus is operated in said first mode of operation and at a second rotational speed when said floor treating apparatus is operated in said second mode of operation, said first rotational speed being significantly greater than said second rotational speed.

* * * * *